United States Patent [19]

Champion

[11] Patent Number: 5,064,404

[45] Date of Patent: Nov. 12, 1991

[54] COIN OR TOKEN DISCHARGE APPARATUS

[75] Inventor: William J. Champion, Holland, Ohio

[73] Assignee: Hamilton Scale Corporation, Toledo, Ohio

[21] Appl. No.: 486,856

[22] Filed: Mar. 1, 1990

[51] Int. Cl.[5] ..... G07D 9/04

[52] U.S. Cl. ..... 453/17; 221/203; 221/312 R; 453/57

[58] Field of Search ..... 453/17, 32, 34, 35, 453/57, 5; 221/182, 203, 312 R

[56] References Cited

U.S. PATENT DOCUMENTS

| | | | |
|---|---|---|---|
| 1,849,318 | 3/1932 | Schwartz . | |
| 2,109,658 | 3/1938 | Zierick | 453/35 X |
| 2,144,568 | 1/1939 | Fialkowski . | |
| 2,222,713 | 11/1940 | Kiss | 453/17 |
| 2,848,158 | 8/1958 | Miller . | |
| 2,881,775 | 4/1959 | Miller . | |
| 3,004,701 | 10/1961 | Antonoff . | |
| 3,209,885 | 10/1965 | Erlichman . | |
| 3,942,544 | 3/1976 | Breitenstein et al. | 453/17 |
| 4,383,540 | 5/1983 | DeMeyer et al. | 453/32 X |
| 4,553,694 | 11/1985 | Siegenthaler . | |

*Primary Examiner*—F. J. Bartuska

*Attorney, Agent, or Firm*—Emch, Schaffer, Schaub & Porcello Co.

[57] ABSTRACT

A coin or token discharge apparatus having a large volume coin reservoir feeding coins or tokens to a coin bowl for engagement with a selector disc and transfer by the selector disc to an exit chute. The discharge apparatus has two baffle members designed to filter and orient the coins or tokens as they are fed to the selector disc. The selector disc includes features which facilitate non-jamming of stray coins or tokens in the rotating selector disc.

6 Claims, 6 Drawing Sheets

COIN OR TOKEN DISCHARGE APPARATUS

BACKGROUND OF THE INVENTION

This invention relates to a coin or token discharge apparatus. Specifically, the apparatus is of the type that receives paper money and returns coins or tokens.

Coin discharge or sorting machines offer a versatile form of changemaking in today's mechanized monetary exchange system. Commonly, many coin or token discharge or coin sorting machines use a rotating selector disc to retrieve coins or tokens and carry them individually to a discharge unit. The coins are normally fed to the selector disc by means of gravity to engage with notches located about the periphery of the selector disc. The notches are adapted to receive a single coin and carry the coin to the discharge chute. Examples of such devices utilizing forms of selector discs are shown in U.S. Pat. Nos. 1,849,318 and 3,004,701.

Coin discharge machines which use a selector disc to carry individual coins to a discharge unit encounter numerous problems when the disc gets jammed by out-of-position coins and then fails to properly function. The jumble of coins or tokens which are present in the hopper above the selector disc can also exert fairly large and uneven forces against the rotating selector disc and actually force coins to engage the selector disc at inopportune locations thus causing the disc to jam and the machine to quit working. The Schwartz patent (U.S. Pat. No. 1,849,318) recognizes the varied problems of jamming and proposes to overcome this defect by constructing a selector disc and distributor which maintains absolute synchronism between the selector disc and the distributor for receiving the coins from the selector at all times. However, the type of apparatus such as Schwartz does not provide a solution to jamming of the selector disc prior to discharge of the coin or token. Schwartz has a shallow coin hopper which cannot carry a large load of coins or tokens. This type of coin hopper requires fairly constant surveillance and maintenance by the personnel in charge of maintaining the coin or token machinery in an operating condition. It has been found that the placement of larger capacity coin hoppers over the commonly available selecto-disc apparatuses results in frequent jamming of the selector disc due to the higher forces and dislocated coins being pressed against the selector disc by those forces.

The Antonoff reference, U.S. Pat. No. 3,004,701, addresses a solution for problems encountered when an oversized coin causes a jam in the coin rotor or selector disc. Antonoff provides an improved guide means for the coin machine wherein smaller diameter coins are prevented from inadvertently becoming displaced from the rotor during rotation while at the same time oversized coins are unable to be carried by the rotor without likelihood of a jam occurring. It has been noted however that such apparatuses fail to provide the problem-free operation demanded of coin and token discharge units having large coin hoppers containing large quantities of coins or tokens.

Accordingly, it is a primary object of this invention to provide a coin or token discharge unit which can carry a large supply of coins or tokens in a supply reservoir.

A further object of this invention is to provide a coin or token discharge unit which provides a rotating selector disc for engaging individual coins and tokens from a large quantity contained in a coin reservoir or hopper and providing those coins or tokens to a discharge chute.

Yet another object of the present invention is to provide an improved anti-jamming apparatus to prevent the selector disc of a coin or token discharge unit from jamming when it attempts to rotate under the heavy and uneven forces of coins piled in the coin reservoir.

A yet further object of the present invention is to provide an improved coin discharge chute which is not jammed by too many coins attempting to enter the chute.

SUMMARY OF THE INVENTION

The coin or token discharge apparatus of the present invention provides a large coin reservoir which is capable of carrying a large supply of coins or tokens. The coin reservoir has a control area proximate the bottom of the reservoir throughwhich the coins are moved by gravity. The control area regulates the number of coins flowing into the coin hopper or bowl. A moveable baffle located between the reservoir and the bowl establishes the size of the control area. As the coins flow into the coin bowl from the reservoir they encounter a lower postioned sorting baffle which forces the coins to gently flow to the selector disc. The selector disc receives the coins at a low point in its rotation and moves the coins along the outside wall of the coin bowl to the coin chute located just beyond the highest point of rotation. The two baffles of the present invention facilitate the flow of coins to the selector disc from a voluminous reservoir and help to ease the forces placed on the selector disc by the coins. Thus the likelihood of the disc jamming is lessened. Further, the selector disc is positioned to rotate off center within the coin bowl thereby providing a second improvement in preventing unwanted jamming of the selector disc during operation.

These advantages of the present invention will become fully clear upon reference to the following description of the preferred embodiment and accompanying drawings.

DETAILED DESCRIPTION OF THE PREFERRED EMBODIMENT

Figure 2:
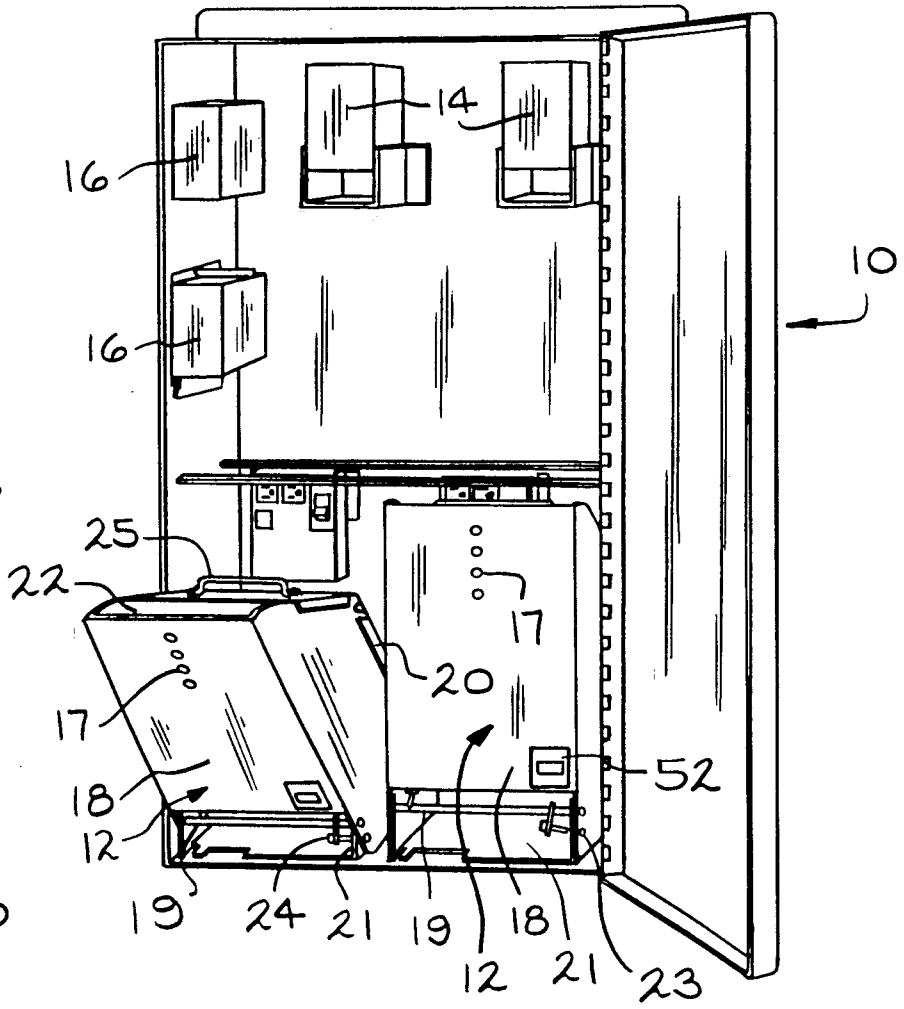
FIG. 2 is a view of the back of a money changing machine having two coin or token discharge units of the present invention positioned therein.
Figure 1:
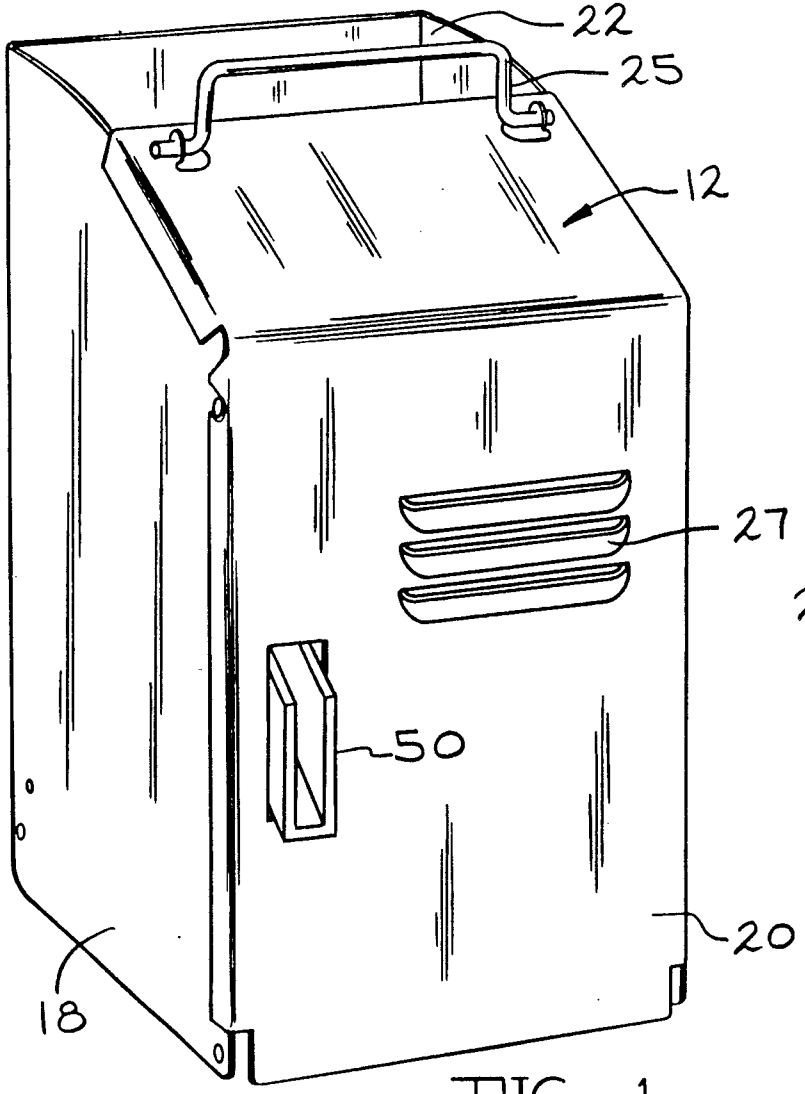
FIG. 1 is a perspective view of the coin or token discharge apparatus of the present invention.

Referring now to FIGS. 1 and 2, a change making apparatus 10 having two coin or token discharge units 12 in accordance with the present invention is shown.

The change maker 10 includes means for receiving paper money 14 and a switching means 16 for activating the paper money receivers and the coin or token discharge units 12. The discharge units 12 can be designed so that they both discharge the same demonination of token or coin or designed to have each unit discharging a different demonination of token or coin.

Each discharge unit 12 has a housing 18 and an outer cover 20. The outer cover 20 does not completely enclose the upper portion of the housing 18 and, therefore, an open access area 22 to the coin reservoir 33 is available. Each discharge unit 12 is mounted on a bracket 21 supported pivot bar 19 within the change making apparatus 10 as shown in FIG. 2. When the coin reservoir of a discharge unit 12 is low on coins or tokens and needs to be refilled, the discharge unit 12 can be rotated outward around the pivot bar 19 from the change maker 10. A locking pin 24 is located on the pivot bar 19. After the discharge unit 12 is rotated outward from the change maker 10, the locking pin 24 is inserted through holes 23 aligned between the housing 18 of the discharge unit 12 and the bracket 21 supporting the pivot bar 19. This locks the discharge unit into an outward facing angular position, thereby providing greater ease in filling the coin reservoir 33 with tokens or coins.

Figure 3:
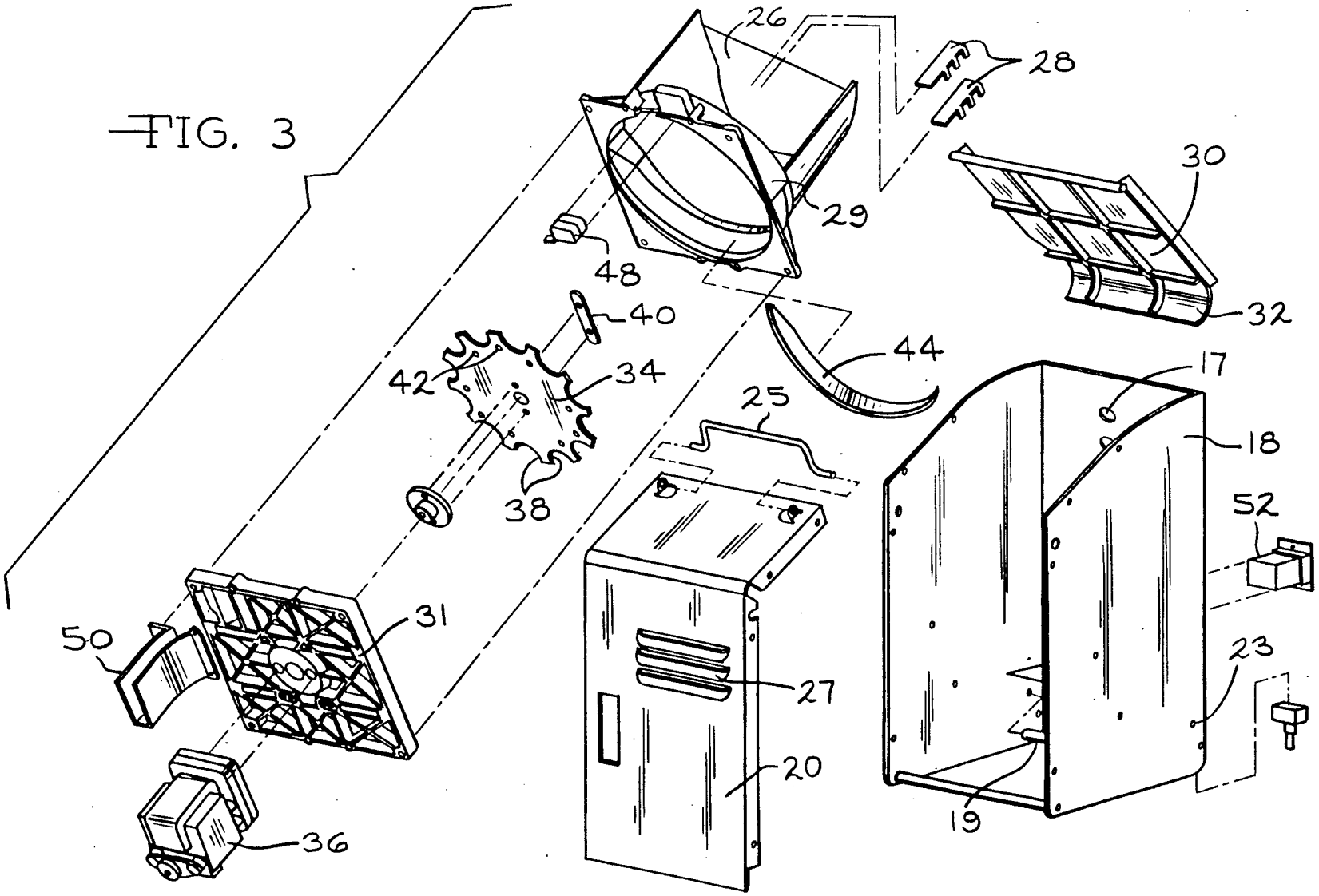
FIG. 3 is an exploded view of the coin or token discharge apparatus of the present invention.
Figure 4:
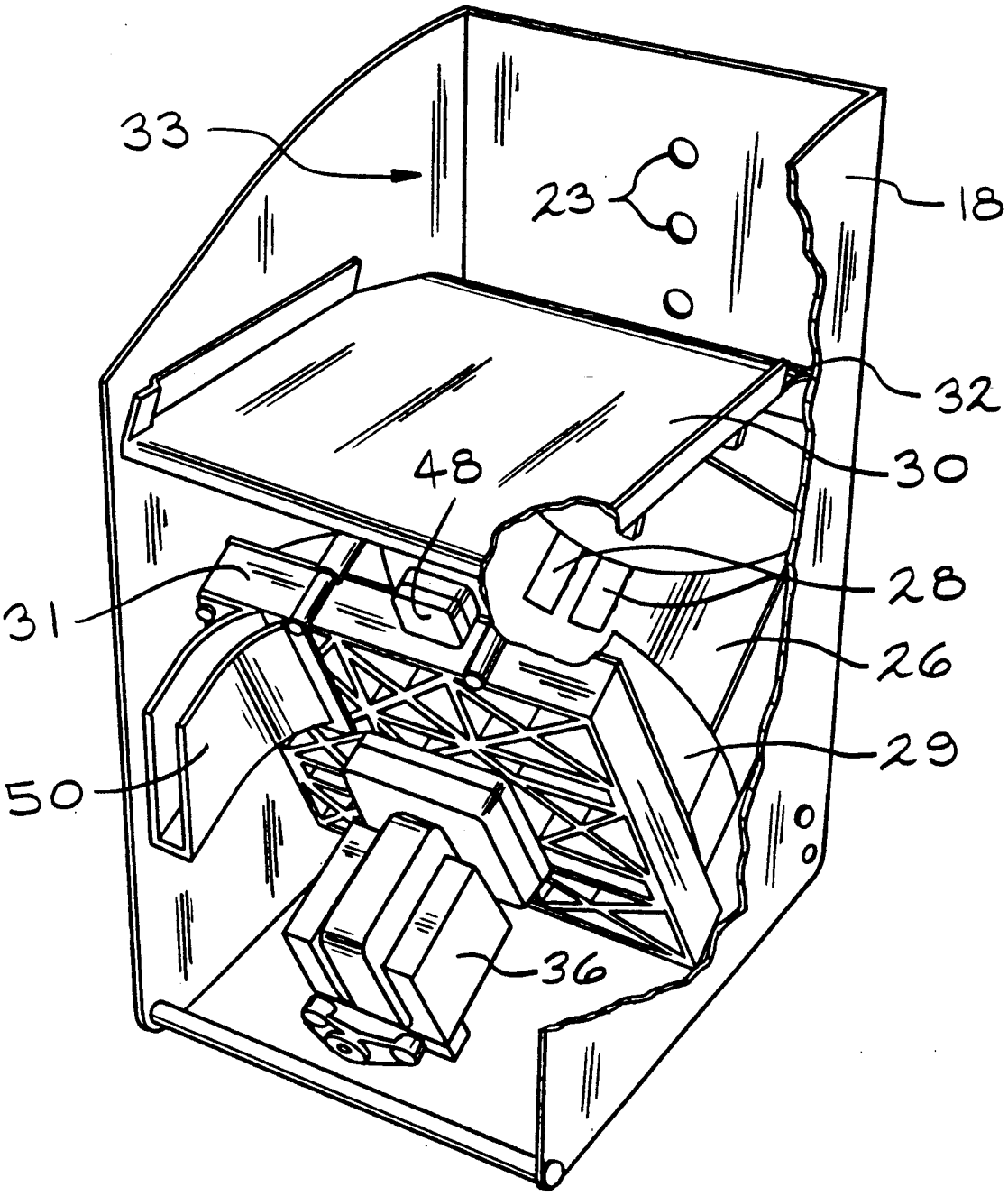
FIG. 4 is a perspective view with cutaway of the coin or token discharge apparatus of the present invention.
Figure 6:
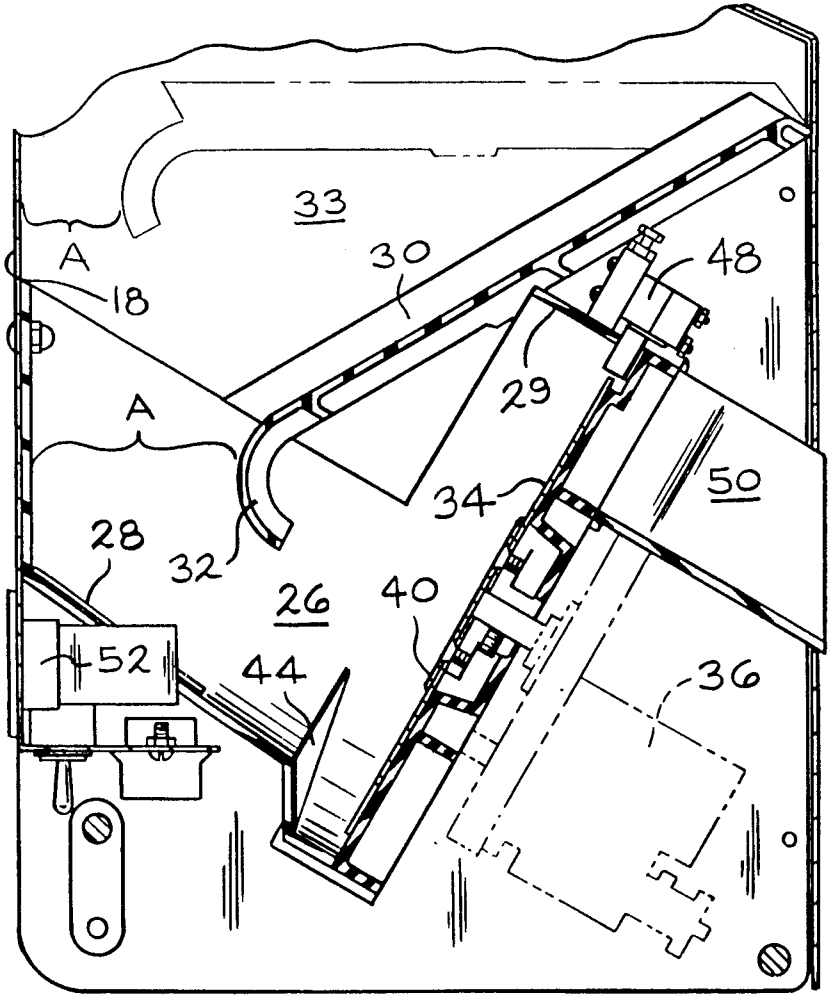
FIG. 6 is a view taken along lines 6—6 of FIG. 5.
Figure 8:
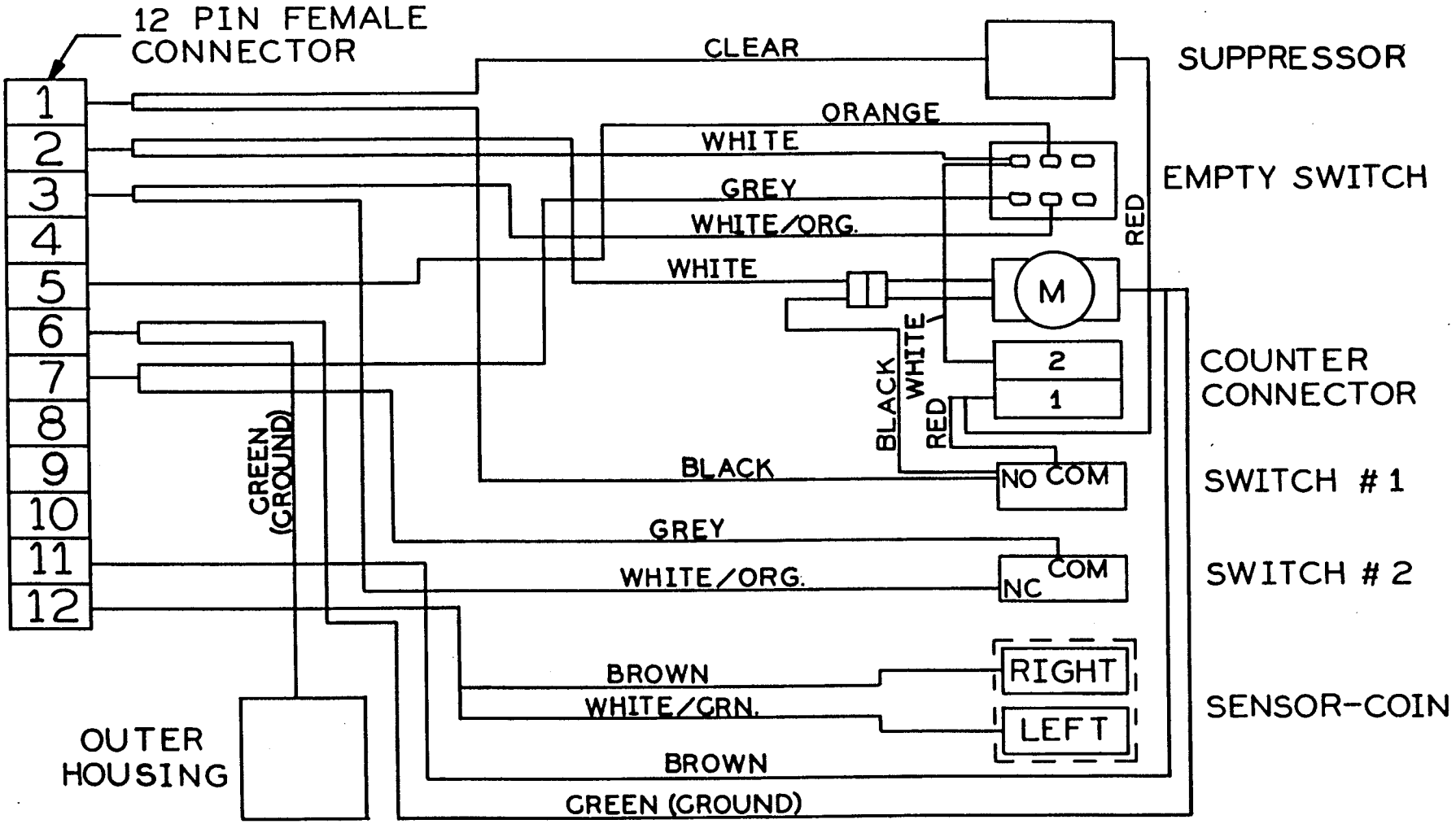

Referring now to FIGS. 3 and 4, the discharge unit 12 has a housing 18 and an outer cover 20. The outer cover 20 preferably includes a handle 25 and vents 27 for releasing motor generated heat. Positioned in the lower end of the housing 18 is the coin bowl 26. Referring to FIG. 6 along with FIGS. 3 and 4, the coin bowl 26 is disposed in an angular position at the bottom of the housing 18 so that coins, when placed in the coin bowl 26, are naturally flowing downward toward the selector disc 34. The coin bowl 26 includes a pair of contact strips 28 positioned in the bottom of the coin bowl 26 which sense the presence of coins or tokens in the bowl. When there are no coins or tokens in contact with the contact strips 28 a circuit is broken (see FIG. 8) and the change maker apparatus 10 is switched to a nonoperable condition.

A circular housing 29 encloses the selector disc 34 in an angular position at the bottom of the coin hopper 26. The selector disc is mounted for rotational movement on a backplate 31, which in turn is fixed to the coin hopper 26. The backplate 31 includes means for mounting a drive motor 36, which is fixed to the selector disc 34 to impart rotational movement to the disc 34. Viewing FIG. 5, the selector disc 34 is positioned in an off-center orientation within the circular housing 29. A gap 46 exists between the circular housing 29 and the edge or periphery of the selector disc 34. The off-center positioning of the selector disc 34 provides for a wide gap **46*a* proximate the exit chute 50 and a narrow gap 46*b* at a location generally 180° removed from the exit chute 50. Thus, as the selector disc 34 rotates in a clockwise direction the gap 46 gradually widens as the exit chute 50 is approached and then gradually narrows again after the exit chute 50** is passed.

The selector disc 34 includes a plurality of notches 38 which are evenly spaced about the periphery of the disc 34. The notches 38 have a radius R designed to provide sufficient clearance for a coin or token of a specific diameter to lay into a specific notch 38 without encountering frictional problems, yet avoid the tendency for a second coin or token to also wedge into the notch 38. The selector disc 34 also includes a stirring bar 40, preferably fixed at the center of the disc 34. Upraised dimples 42 are spaced about the selector disc 34 to also assist in stirring or mixing the coins and tokens.

Figure 5:
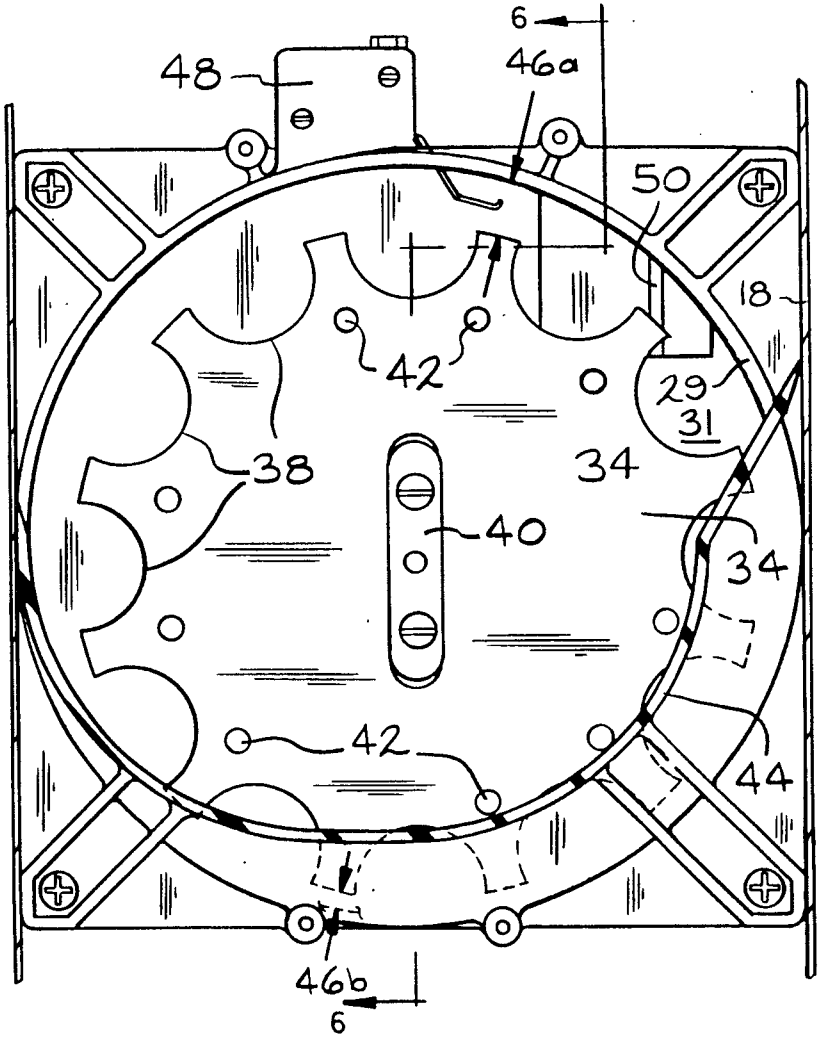
FIG. 5 is a detailed view of the coin bowl and selector disc of the coin or token discharge apparatus of the present invention.

Referring now to FIGS. 5 and 6, an upper baffle 30 is positioned on top of the coin bowl 26 to separate the coin bowl 26 from the coin reservoir 33. The upper baffle 30 is fixed to the coin bowl 26 so that the baffle 30 can pivot upwardly from its normal resting position atop the coin bowl 26. The free end 32 of the upper baffle 30 is curved, preferably about a radius of 0.875 inches. The curvature of the baffle end 32 continues beyond a parallel with the plane of the baffle 30 by about 30 degrees. This curvature of the baffle end 32 assists in preventing unwanted bridging of the coins or tokens across area A, resulting in a stoppage of the flow of coins. In its normal resting position, the baffle end 32 is positioned to allow a free flow of coins or tokens through the area A from the coin reservoir 33 into the coin bowl 26. The rate of flow of the coins or tokens into the coin bowl 26 is solely controlled by the area A. As the coins enter the coin bowl 26 they build up under the baffle end 32 and force the upper baffle 30 to pivot upwardly into the coin reservoir 33. As the upper baffle 30 pivots upwardly, the area A is narrowed, thereby forcing a reduction in the flow of coins into the coin bowl 26. Conversely, if the number of coins in the coin bowl 26 is greatly reduced, the weight of the coins in the coin reservoir 33 will press the upper baffle 30 back into its normal resting position.

A lower baffle 44 is positioned in front of and spaced from the lower portion of the selector disc 34. The lower baffle 44 is of a gradually decreasing height and the spacing between the lower baffle 44 and selector disc 34 is gradually increasing when taken in the clockwise direction, so that the coins or tokens will freely flow over it in a clockwise movement to engage the selector disc 34. The upper baffle 30 and the lower baffle 44 act in cooperation to filter the coins or tokens to the selector disc 34 in a semi-organized fashion.

Figure 7:
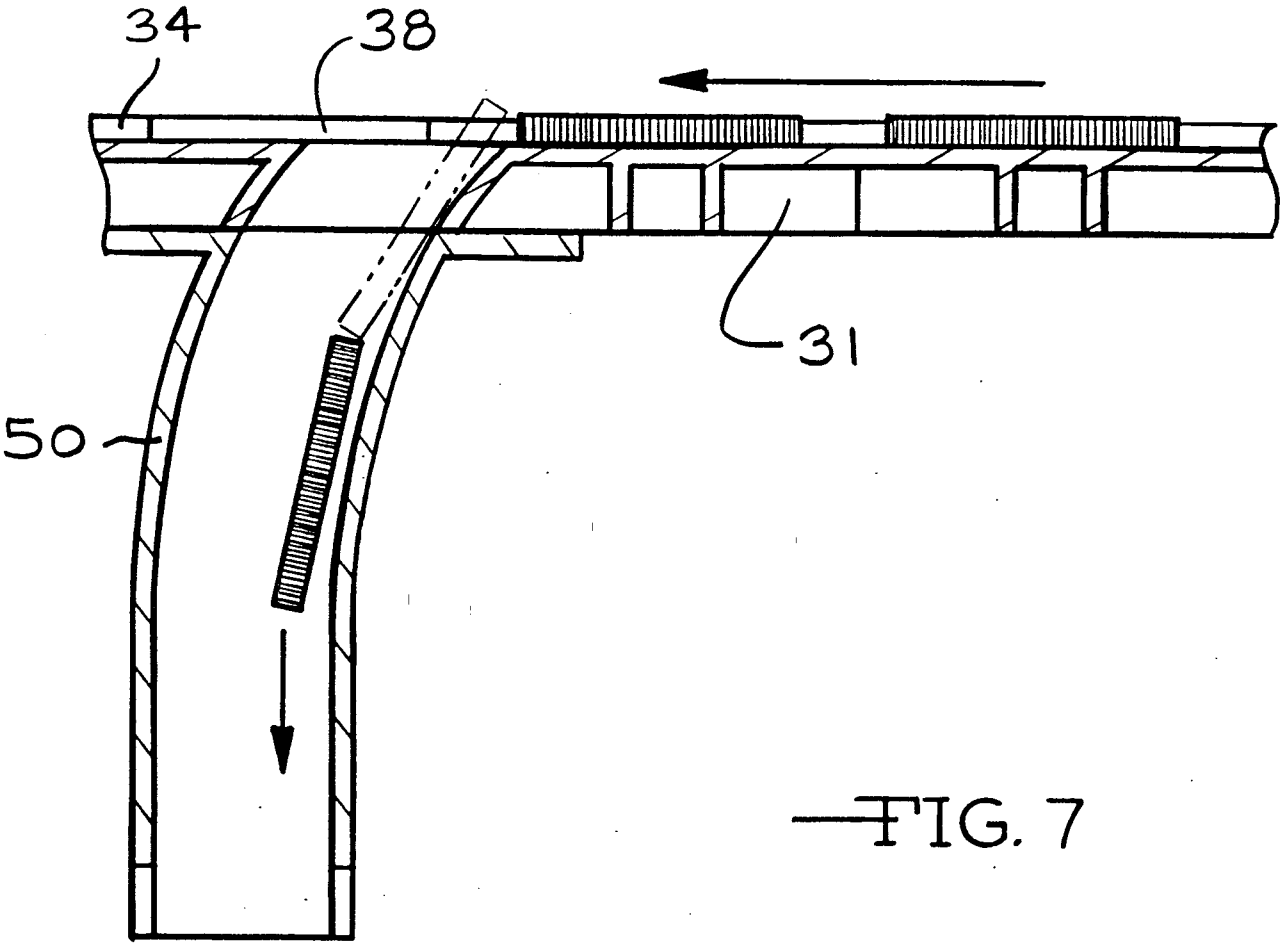
FIG. 7 is a top view of the exit chute of the coin or token discharge apparatus; and, FIG. 8 is an electrical schematic for the wiring of the coin or token discharge apparatus of the present invention.

Referring now to FIGS. 5, 6 and 7, the exit chute 50 is located to the right of top center when viewing the selector disc 34 in position on the backplate 31. The exit chute 50 curves through the backplate 31 in a downward orientation to deliver the coins or tokens to a delivery dish (not shown) in the front of the change making apparatus 10. The location of the exit chute 50 forces the coins to pass the uppermost level of rotation of the selector disc 34. During the transportation of coins by the selector disc 34, some of the coins that are not specifically engaged within the notches 38 of the selector disc 34 are driven up toward the exit chute 50 by the stirring bar 40 and the upraised dimples 42. If the stray coins reach the opening of the exit chute 50, there is a potential for the stray coins to jam between the notches 38 on the selector disc 34 and the exit chute 50. By having the exit chute 50 located beyond the uppermost point of travel, stray coins will drop back into the bottom of the coin bowl 26 before reaching the exit chute 50.

A contact switch 48 is also located at the uppermost portion of the travel for the selector disc 34. The contact switch 48 is activated by each coin passing to the exit chute 50 thereby providing an accurate count to the number of coins which have been discharged. The counter 52 is located at the lower corner of the housing 18 for ease of reference.

For operation, the coin or token discharge apparatus of the present invention is usually mounted in a change making machine as shown in FIG. 1. The exit chute 50 of the coin or token discharge apparatus 12 is engaged with a coin or token delivery bowl (not shown) located at the front of the change making machine 10. To activate the machinery, the coin or token discharge unit 12 is rotated outwardly from the back of the change making unit 10 to the position shown in FIG. 2 so that the coin reservoir 33 can be supplied with coins or tokens. The locking pin 24 is inserted through the holes in the housing 18 of the discharge unit 12 and bracket 21 holding the pivot bar 19. After the coin reservoir 33 is filled, the discharge unit 12 is rotated into its operating position within the change maker 10. Sighting holes 17 can be used to provide casual observation as to the level of coins in the coin reservoir.

Referring to FIGS. 5, 6 and 7, the coins contained in the coin reservoir 33 will flow through the area A to fill the coin bowl 26. As the coins flow through the area A they pass the curved baffle end 32 and slide over the lower baffle 44 to rest against the selector plate 34. If too many coins flow into the coin bowl 26, the upper baffle 30 will pivot upwardly under the pressure of the flow coins to narrow the area A through which the coins flow. The selector disc 34 is rotating in a clockwise direction and the coins engage the notches 38 of the selector disc 34 as they flow over the lower baffle 44. The notches 38 of the selector disc carry the coins toward the exit chute 50. Because the gap 46 between the periphery of the selector disc and the circular housing 29 of the coin bowl 26 is gradually increasing as the coins are carried toward the exit chute 50, any loose or stray coins which may be caught in the gap 46 will become loosened and fall to the bottom of the coin bowl 26. The stirring bar 40 and upraised dimples 42 further act to agitate stray coins and prevent them from being carried while out of position by the notches 38 toward the exit chute 50. Thus, the combined effect of the gradually increasing gap 46, stirring bar 40, upraised dimples 42, and upper baffle 30 and lower baffle 44 all facilitate the non-jamming features of the present invention.

The above description of the preferred embodiment is intended for illustrative purposes and is not intended to be limiting upon the scope and content of the following claims.

I claim:

1. A coin or token discharge apparatus comprising, in combination:

a coin reservoir for holding a large volume of coins or tokens;

a upper baffle member positioned in said coin reservoir to define a coin bowl and a flow channel, wherein such coins or tokens held in said coin reservoir move through said flow channel to said coin bowl, said upper baffle member being fixed to a pivot member whereby said upper baffle member can rotate about said pivot member into said coin reservoir and, as a result of such pivoting action, narrow such flow channel between said coin reservoir and said coin bowl; and a rotating selector disc positioned in said coin bowl, said selector disc being adapted to receive individual coins or tokens and transport such coins or tokens to an exit chute located in the upper quadrant of travel of said selector disc which is beyond the highest point of travel of said selector disc.

2. The coin or token discharge apparatus of claim 1 further including a lower baffle member positioned in spaced relationship to the lower periphery of said selector disc for filtering such coins or tokens to said selector disc from said coin bowl.

3. The coin or token discharge apparatus of claim 1, wherein said coin bowl includes a generally circular housing around the periphery of said selector disc with a gap defined between the peripheral edge of said selector disc and said circular housing, said gap having a desired dimension at the location proximate said exit chute and gradually narrowing in dimension around said selector disc to a second desired dimension, less than said first desired dimension, located at a point generally 180° removed from said exit chute.

4. The coin or token discharge apparatus of claim 1, wherein said selector disc includes a plurality of notches formed around the periphery of said selector disc, said notches being of a radius designed to facilitate the engagement of single coins or tokens within said notches for carrying to said exit chute.

5. The coin or token discharge apparatus of claim 1 further including an agitation means for stirring such coins or tokens as such coins or tokens are resting against said rotating selector disc.

6. The coin or token discharge apparatus of claim 1 further including means for rendering said discharge apparatus inoperable should the level of coins or tokens retained in said coin bowl reach a predetermined minimum.

* * * * *